US007138966B2

(12) United States Patent
Shindo et al.

(10) Patent No.: US 7,138,966 B2
(45) Date of Patent: Nov. 21, 2006

(54) PLASMA DISPLAY PANEL DISPLAY AND ITS DRIVING METHOD

(75) Inventors: Katsutoshi Shindo, Higashiosaka (JP); Kenji Ogawa, Takatsuki (JP); Shigeyuki Okumura, Daito (JP); Takatsugu Kurata, Ibaraki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 258 days.

(21) Appl. No.: 10/480,557

(22) PCT Filed: Jun. 11, 2002

(86) PCT No.: PCT/JP02/05769

§ 371 (c)(1),
(2), (4) Date: Jun. 4, 2004

(87) PCT Pub. No.: WO02/101706

PCT Pub. Date: Dec. 19, 2002

(65) Prior Publication Data

US 2004/0233134 A1 Nov. 25, 2004

(30) Foreign Application Priority Data

Jun. 12, 2001 (JP) ..... 2001-176576

(51) Int. Cl.
*G09G 3/28* (2006.01)

(52) U.S. Cl. ..... 345/63; 345/89; 315/169.4

(58) Field of Classification Search ..... 345/60–65, 345/690–696, 89, 90; 315/169.1–169.4; 313/491, 492, 485, 582
See application file for complete search history.

(56) References Cited

U.S. PATENT DOCUMENTS

| | | | | |
|---|---|---|---|---|
| 6,294,875 | B1 | 9/2001 | Kurata et al. | 315/169.1 |
| 6,317,104 | B1 | 11/2001 | Kasahara et al. | 345/63 |
| 6,369,782 | B1 | 4/2002 | Shigeta | 345/63 |
| 6,545,405 | B1 * | 4/2003 | Shino et al. | 313/491 |
| 6,965,358 | B1 * | 11/2005 | Kasahara et al. | 345/63 |

FOREIGN PATENT DOCUMENTS

| | | |
|---|---|---|
| JP | 10-3281 | 1/1998 |
| JP | 11-7264 | 1/1999 |
| JP | 2000-98958 | 4/2000 |
| JP | 2000-214823 | 8/2000 |
| JP | 2000-261739 | 9/2000 |
| JP | 2000-330512 | 11/2000 |

* cited by examiner

*Primary Examiner*—Wilson Lee

(57) ABSTRACT

The present invention provides a plasma display device for displaying a high quality image, and its driving method, with which the production cost and power consumption may be reduced and write errors may be suppressed. In the driving method, the length of the erase period D2 is $T_0$+160 μsec, based on the number of sustain pulses being greater than or equal to 25 and less than 50 in the discharge sustain period C2. The length is set by a T1 setting unit according to the information on the number of the sustain pulses sent from a preprocessor in a driving unit, and a T1 table stored in a T1 table storage unit. The T1 setting unit sets $T_1$=160 μsec referring to an extension time period $T_1$ corresponding to the number of sustain pulses that is greater than or equal to 25 and less than 50 in the T1 table.

17 Claims, 9 Drawing Sheets

PLASMA DISPLAY PANEL DISPLAY AND ITS DRIVING METHOD

TECHNICAL FIELD

The present invention relates to a plasma display device that is used as a display device, and a method of driving the same.

BACKGROUND ART

In recent years, development for display panels such as cathode ray tubes, liquid crystal displays, and plasma display panels (hereinafter referred to as PDPs) has been aggressively pursued, as the demand for large-sized and high-definition display devices like hi-vision displays becomes increasingly larger.

Among various kinds of display panels, the PDPs are the most appropriate in order to make a thinner and larger display, and a 60-inch PDP has already been developed. AC surface discharge PDPs are the current main stream because this type is the most appropriate in order to make a thinner and larger display.

An AC PDP has such a structure that a front panel and a back panel face each other with barrier ribs therebetween, and a discharge gas mainly composed of a rare gas is enclosed in a discharge space between the two panels.

The front panel is such that scanning electrodes and sustaining electrodes are disposed in stripes on a main surface of a front substrate, and a dielectric layer made of lead-based glass and the like and a protecting layer made of MgO are layered in an order over the scanning and sustaining electrodes.

The back panel is such that data electrodes are disposed in stripes on a main surface of a back substrate, and a dielectric layer made of lead-based glass and the like is layered on the data electrodes. Further, plural lines of barrier ribs are disposed on the dielectric layer in parallel with the data electrodes, and phosphor layers, each being either red (R), green (G), or blue (B), are each disposed on walls of each gap enclosed by the dielectric layer and two adjacent barrier ribs.

In the AC PDP, each discharge cell corresponds to a part in the discharge space where the scanning and sustaining electrodes on the front panel and the data electrodes on the back panel cross with an overpass.

A plasma display device comprises the above described AC PDP and a driving circuit for driving the PDP.

In such a plasma display device, each discharge cell can only display two scales by either emitting light or not emitting light. Therefore, the AC plasma display device generally adopts an intra-field time division grayscale display method in order to display an image in grayscale. The intra-field time division grayscale display method is to display a grayscale image by dividing a field (16.6 msec) into plural subfields so as to divide light emission time into time slots. A field is a time unit for display.

Further, each subfield includes an initialization period, a write period, a discharge sustain period, and an erase period. An image is displayed by driving the PDP through each subfield including these periods.

However, the plasma display device having the above structure and adopting the above driving method is susceptible to charge errors where wall charge is not accumulated on surfaces of the phosphor layers or a surface of the protecting layer over the scanning electrodes, and instead, discharged out in the discharge space. This kind of charge errors in the write period leads to write errors and becomes one cause of deterioration of image qualities.

The above described write errors can be suppressed to an extent, by setting a write pulse voltage during the write period high. However, this is not a desirable solution because making the write pulse voltage high requires an IC having a high voltage resistance, or increases power consumption of an entire plasma display device.

DISCLOSURE OF THE INVENTION

The present invention is made in view of the above circumstance. An object of the present invention is to provide a plasma display device with high image qualities and less write errors during a write period, whose production cost and power consumption are low, as well as to provide a method of driving the plasma display device.

A plasma display device according to the present invention is a plasma display device comprising (i) a plasma display panel with a plurality of discharge cells between front and back panels, and (ii) a driving circuit operable to drive the plasma display panel to display a grayscale image by selectively having the discharge cells emit light in a subfield with a desired luminance weight, a plurality of subfields with different luminance weights forming one field, wherein each subfield includes a write period and a discharge sustain period, and at least two subfields are in a relation that (i) a number of sustain pulses applied in an m-th subfield is different from that in an n-th subfield, and (ii) a first time period from an end of the discharge sustain period in the m-th subfield until an application of a write pulse in an (m+1)-th subfield is different in length from a corresponding second time period between the n-th subfield and an (n+1)-th subfield.

With such a plasma display device, it is possible to set a time period appropriate to effectively suppress the charge errors where the charges are not accumulated due to an impurity level, because, based on the number of the sustain pulses applied in the discharge sustain period in the m-th subfield, at least two subfields are in the relation that the first time period from the end of the discharge sustain period in the m-th subfield until the application of the write pulse in the (m+1)-th subfield is different in length from the corresponding second time period between the n-th subfield and the (n+1)-th subfield.

In other words, with the above plasma display device, the time period from the end of the discharge sustain period in one subfield until the application of the write pulse in the succeeding subfield is set accordingly based on the number of the applied sustain pulses, instead of making the said time period longer equally for all subfields. By doing so, it is possible to suppress the charge errors effectively without making the time period from the end of the discharge sustain period in one subfield until the application of the write pulse in the succeeding subfield too long.

Therefore, with the above plasma display device, it is possible to obtain a plasma display device with a low power consumption, high image qualities and less write errors during a write period.

Specifically, it is preferable that, when the number of the sustain pulses in the m-th subfield is greater than or equal to a predetermined number, the first time period is calculated by adding an extension time period that is set based on the number of the sustain pulses in the m-th subfield to a base time period, where the base time period is a length of time from an end of the discharge sustain period in any subfield having sustain pulses less than the predetermined number until an application of the write pulse in a succeeding subfield.

The predetermined number may be the number of the sustain pulses in a field having in which a number of sustain pulses applied is the smallest.

It is also preferable for the above plasma display device that the extension time period is set in a range of 20 μsec to 300 μsec when the number of the sustain pulses in the m-th subfield is greater than or equal to 25 and less than 50, 40 μsec to 320 μsec when the number of the sustain pulses in the m-th subfield is greater than or equal to 50 and less than 80, and 60 μsec to 340 μsec when the number of the sustain pulses in the m-th subfield is greater than or equal to 80.

It is also preferable for the above plasma display device that a length of time from the end of the discharge sustain period in each subfield until the application of the write pulse in a succeeding subfield is set in a range of 10 μsec to 820 μsec.

Further, the present invention may be easily implemented when the driving circuit comprises: a table storage unit that stores a table in which numbers of the sustain pulses correspond to extension time periods; and an extension time period setting unit operable to set the extension time period based on the number of the sustain pulses in the m-th subfield by referring to the table.

Here, it is preferable that an erase period in which a wall charge is erased is provided after the discharge sustain period in the m-th subfield, and the extension time period is included in the erase period.

It is preferable for the plasma display device of the present invention that a length of the erase period in each subfield is set in a range of 160 μsec to 460 μsec.

It is even more preferable that the length of the erase period is set for each field based on a total number of the sustain pulses applied in a preceding field.

It is also preferable that when an initialization period in which a charge is initialized is provided before the write period in each subfield, the extension time period is included in the initialization period in the m-th subfield.

It is preferable for the plasma display device of the present invention that a length of the initialization period in each subfield is set in a range of 360 μsec to 660 μsec.

Further, it is also preferable for the above plasma display device that, when a total number of the sustain pulses applied in one field is greater than or equal to another predetermined number, another extension time period is added to the length of time from the end of the discharge sustain period in each subfield until the application of the write pulse in a succeeding field. This driving method was developed by focusing on a fact that an amount of wall charge accumulated in one field is different from that in other fields. It is possible to suppress charge errors where the charges are not accumulated due to an impurity level by adding another extension time when the number of the pulses applied in a preceding field is large.

A method of driving a plasma display device according to the present invention is a method of driving a plasma display device, the plasma display device including (i) a plasma display panel with a plurality of discharge cells between front and back panels, and (ii) a driving circuit operable to drive the plasma display panel to display a grayscale image by selectively having the discharge cells emit light in a subfield with a desired luminance weight, a plurality of subfields with different luminance weights forming one field, wherein each subfield includes a write period and a discharge sustain period, and at least two subfields are in a relation that (i) a number of sustain pulses applied in an m-th subfield is different from that in an n-th subfield, and (ii) a first time period from an end of the discharge sustain period in the m-th subfield until an application of a write pulse in an (m+1)-th subfield is different in length from a corresponding second time period between the n-th subfield and an (n+1)-th subfield.

With such a driving method, it is possible to set a time period appropriate to effectively suppress the charge errors where the charges are not accumulated due to an impurity level, because, based on the number of the sustain pulses applied in the discharge sustain period in the m-th subfield, at least two subfields are in a relation that (i) a number of sustain pulses applied in an m-th subfield is different from that in an n-th subfield, and (ii) a first time period from an end of the discharge sustain period in the m-th subfield until an application of a write pulse in an (m+1)-th subfield is different in length from a corresponding second time period between the n-th subfield and an (n+1)-th subfield.

In other words, with the above driving method, the time period from the end of the discharge sustain period in one subfield until the application of the write pulse in the succeeding subfield is set accordingly based on the number of the applied sustain pulses, instead of making the said time period longer equally for all subfields. By doing so, it is possible to suppress the charge errors effectively without making the time period from the end of the discharge sustain period in one subfield until the application of the write pulse in the succeeding subfield too long.

Therefore, with the above driving method, it is possible to realize a low power consumption, high image qualities and less write errors during a write period.

Specifically, it is preferable that, when the number of the sustain pulses in the m-th subfield is greater than or equal to a predetermined number, the first time period is calculated by adding an extension time period that is set based on the number of the sustain pulses in the m-th subfield to a base time period, where the base time period is a length of time from an end of the discharge sustain period in any subfield having sustain pulses less than the predetermined number until an application of the write pulse in a succeeding subfield.

The predetermined number may be the number of the sustain pulses in a field having in which a number of sustain pulses applied is the smallest.

It is also preferable for the above driving method that the extension time period is set in a range of 20 μsec to 300 μsec when the number of the sustain pulses in the m-th subfield is greater than or equal to 25 and less than 50, 40 μsec to 320μsec when the number of the sustain pulses in them-th subfield is greater than or equal to 50 and less than 80, and 60 μsec to 340 μsec when the number of the sustain pulses in the m-th subfield is greater than or equal to 80.

It is also preferable for the above driving method that a length of time from the end of the discharge sustain period in each subfield until the application of the write pulse in a succeeding subfield is set in a range of 10 μsec to 820 μsec.

It is also preferable for the above driving method that the extension time period is set by referring to the table in which numbers of the sustain pulses correspond to extension time periods.

It is also preferable for the above driving method that, when a total number of the sustain pulses applied in one field is greater than or equal to another predetermined number, another extension time period is added to the length of time from the end of the discharge sustain period in each subfield until the application of the write pulse in a succeeding field.

It is also preferable that, when an erase period in which a wall charge is erased is provided after the discharge sustain period in the m-th subfield, the extension time period is included in the erase period.

It is also preferable for the above driving method that the extension time period is included in the erase period in the m-th subfield.

It is also preferable for the above driving method that the extension time period is included in the initialization period in the m-th subfield.

BEST MODE FOR CARRYING OUT THE INVENTION

Although the present invention is explained in reference to preferred embodiments and drawings, those embodiments and drawings are for illustrating examples of the present invention. The present invention is not limited to those examples.

1. Overall Structure of PDP

Figure 1:
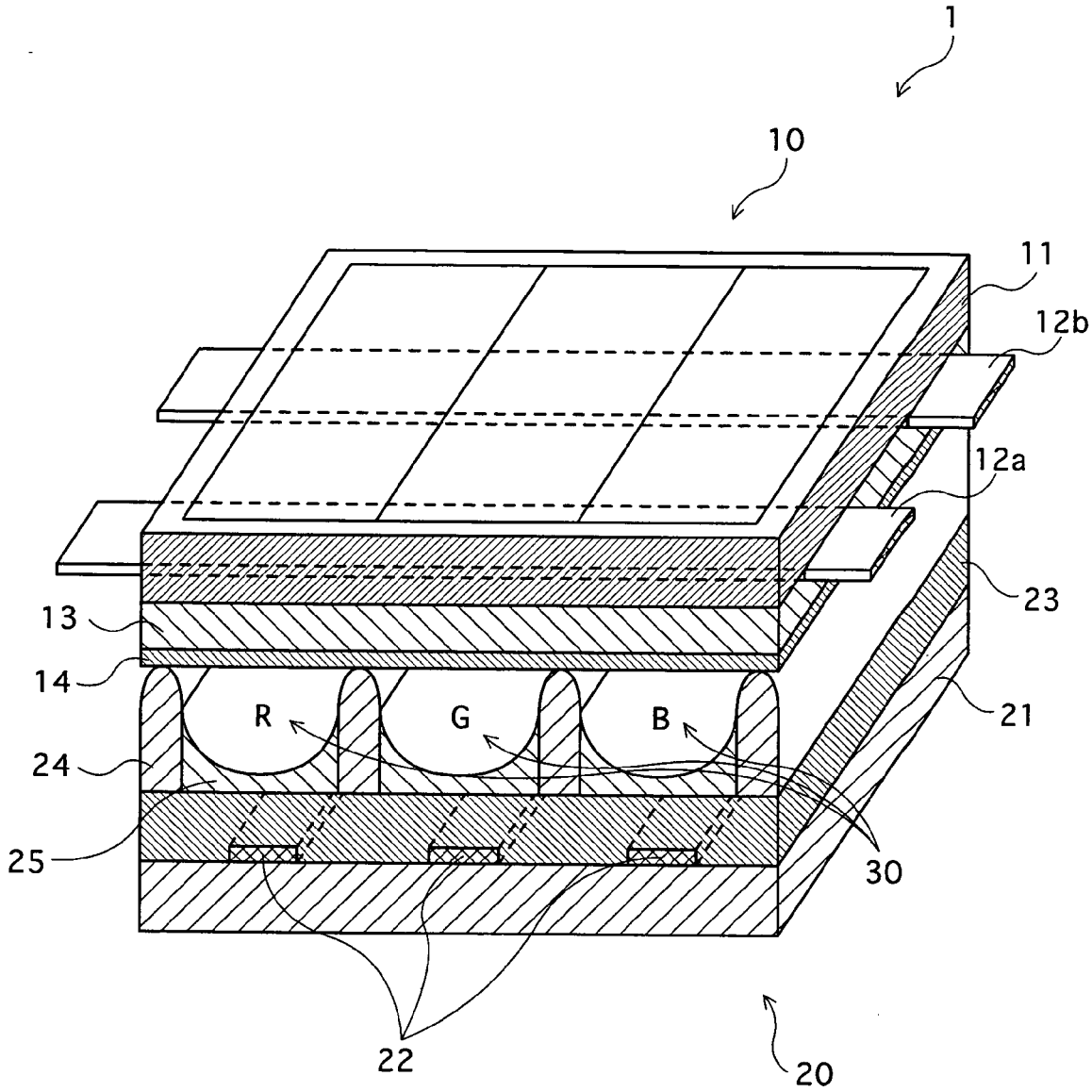
FIG. 1 is a perspective view (partially cross sectional) of a main part of an AC plasma display device of embodiments of the present invention.

An AC PDP (hereinafter referred to as PDP) 1 according to the embodiments of the present invention is explained in reference to FIG. 1. FIG. 1 is a perspective view (partially cross sectional) of a main part of an AC plasma display device of embodiments of the present invention, and illustrates a part of displaying area of the PDP.

As shown in FIG. 1, the PDP 1 has such a structure that a front panel 10 and a back panel 20 face each other with a space therebetween. The space between the front panel 10 and the back panel 20 is divided into discharge spaces 30 by plural lines of barrier ribs 24 that are disposed on a main surface of the back panel 20.

The front panel 10 is such that scanning electrodes 12*a* and sustaining electrodes 12*b* both mainly made of Ag are alternately disposed in stripes on one of main surfaces of a front glass substrate 11, and a dielectric glass layer 13 made of lead-based low-melting glass is disposed on the front glass substrate 11 so as to cover the electrodes 12*a* and 12*b*. A dielectric protecting layer 14 made of MgO is layered on the dielectric glass layer 13.

The back panel 20 is such that data electrodes 22 are disposed in stripes on a facing surface of a back glass substrate 21 to the front panel 10, and a dielectric glass layer 23 containing $TiO_2$ covers the surface of a back glass substrate 21 on which the data electrodes 22 are disposed. Further, the barrier ribs 24 are disposed on the dielectric glass layer 23 in parallel with the data electrodes 22 so that each of the barrier ribs 24 is positioned between two adjacent data electrodes 22. Phosphor layers 25, each being either red (R), green (G), or blue (B), are each disposed on walls of each gap enclosed by the dielectric glass layer 23 and two adjacent barrier ribs 24.

The front panel 10 and the back panel 20 are positioned so that the scanning electrodes 12*a* and the sustaining electrodes 12*b* on the front panel and the data electrodes 22 on the back panel cross with an overpass, and are sealed with an air-tight seal (glass frit) at edges of the panels (not shown in the drawing).

The discharge spaces 30 are spaces enclosed by the dielectric protecting layer 14 on the front panel 10, and a phosphor layer 25 or the barrier ribs 24. In the discharge spaces 30, a discharge gas mainly composed of He—Xe or Ne—Xe as a gas base is enclosed.

In the PDP 1, a discharge cell corresponds to a part in a discharge space 30 where the scanning electrodes 12*a* and the sustaining electrodes 12*b* on the front panel 10 and the data electrodes 22 on the back panel 20 cross with an overpass.

2. Method of Manufacturing PDP 1

2-1 Manufacturing Front Panel 10

In manufacturing the front panel 10, first, the scanning electrodes 12*a* and the sustaining electrodes 12*b* are formed by applying a paste for silver electrodes to the front glass substrate 11 using screen printing, and then baking.

Next, the dielectric glass layer 13 is formed by applying a paste containing lead-based low-melting glass material to the front glass substrate 11 using screen printing, so as to cover parts where the electrodes 12*a* and 12*b* are formed, and then baking at a temperature in a range of 550° C. to 590° C. An example of a composition of the dielectric glass layer 13 is lead oxide (PbO) 70 wt %, boron oxide ($B_2O_3$) 15 wt %, and silicon oxide ($SiO_2$) 15 wt %.

Note that, a bismuth low-melting glass may also be used instead of the above described method, in order to form the dielectric glass layer 13. It is also possible that the lead-based low-melting glass and the bismuth low-melting glass are layered.

Further, using a vacuum evaporation method, the dielectric protecting layer 14 made of MgO is formed on the front glass substrate 11 on which a dielectric glass layer 13 has been formed.

Note that, other methods such as spattering and application may also be used in order to form the dielectric protecting layer 14, instead of the vacuum evaporation method.

2-2 Manufacturing Back Panel 20

In manufacturing the back panel 20, first, the data electrodes 22 are formed by applying a paste for silver electrodes to the back glass substrate 21 using screen printing, and then baking.

Next, the (white) dielectric glass layer 23 is formed by applying a paste of glass material containing particles of titaniumoxide ($TiO_2$) to the back glass substrate 21 using screen printing, so as to cover the data electrodes 22, and then baking at a temperature in a range of 550° C. to 590° C.

Then, the barrier ribs 24 are formed by applying a glass paste for barrier ribs to the dielectric glass layer 23 using screen printing, and then baking.

Next, the phosphor layers 23 are formed by applying the phosphor pastes each being red (R), green (G), and blue (B) to the walls of the gaps enclosed by the barrier ribs 24 and the dielectric glass layer 23 using screen printing, and then baking in an atmosphere (for 10 minutes at 500° C., for example). In the embodiments, the following phosphor material is used to form the phosphor layers 25.

Red Phosphor: $(Y_xGd_{1-x})BO_3:Eu^{3+}$, or $YBO_3:Eu^{3+}$

Green Phosphor: $BaAl_{12}O_{19}:Mn$, or $Zn_2SiO_4:Mn$

Blue Phosphor: $BaMgAl_{10}O_{17}:Eu^{2+}$

The back panel 20 is manufactured in the above described manner.

Note that it is also possible to employ a different method in forming the phosphor layers 25, such as an inkjet method, a line jet method, and a method in which first manufacture photosensitive resin sheets containing phosphor material having each color, and the sheets are attached on the back glass substrate 21 on the surface where the barrier ribs 24 are disposed, and then unnecessary parts are removed by patterning and developing using photolithography.

2-3 Sealing of Front Panel 10 and Back Panel 20

Next, the front panel 10 and the backpanel 20 manufactured in the above described manner are sealed together using a sealing glass.

After the sealing, air in the discharge spaces 30 is exhausted to a high vacuum (e.g. $1\times10^{-4}$ Pa), and then the discharge gas is enclosed at a predetermined pressure.

As the discharge gas to be enclosed in the discharge spaces 30, a mixed gas of Ne and Xe (ratio of 95:5 vol %) is used in the embodiments. The discharge gas is enclosed at a pressure of about $7\times10^{-4}$ Pa.

3. Overall Structure of Plasma Display Device

Figure 2:
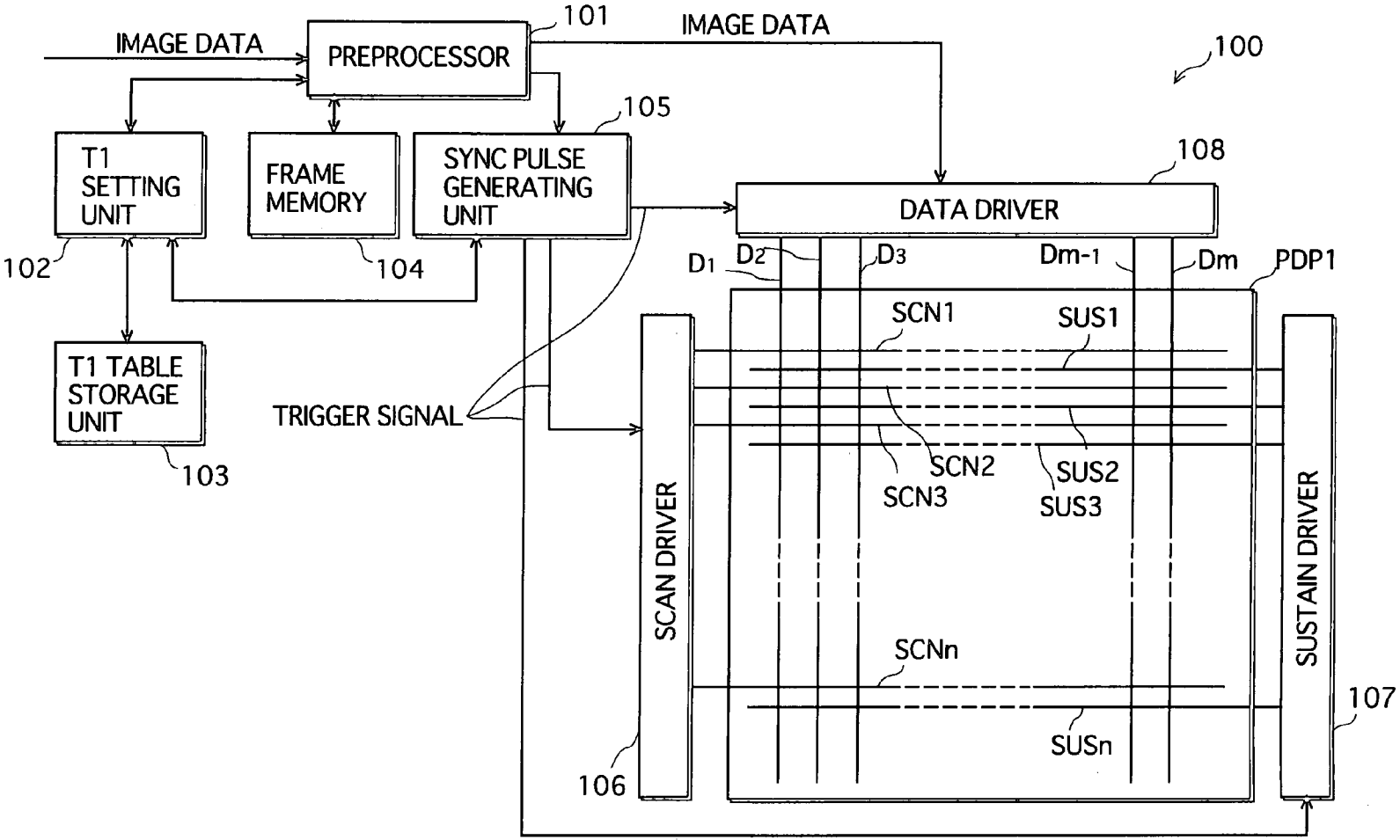
FIG. 2 is a block diagram illustrating an overall structure of the AC plasma display device of the embodiments of the present invention.

Next, an overall structure of a plasma display device having the above PDP 1 is explained in reference to FIG. 2.

As shown in FIG. 2, the plasma display device comprises the PDP 1 and a driving unit 100 for driving the PDP 1.

The driving unit 100 includes a preprocessor 101, a T1 setting unit 102, a T1 table storage unit 103, a frame memory 104, a sync pulse generating unit 105, a scan driver 106, a sustain driver 107, a data driver 108, and such. The plasma display device is also provided with a power source circuit (not shown in the drawing) for supplying power to the drivers 106, 107, and 108.

The preprocessor 101 extracts a field display signal for each field out of a display signal inputted by an external image outputting unit, and generates subfield image signals for each subfield from the field display signal, and stores the generated subfield image signals in the frame memory 104.

The preprocessor 101 also outputs the subfield display signals that are currently stored in the frame memory 104 to the data driver 108 line by line, detects sync signals such as a horizontal sync signal and a vertical sync signal in the inputted display signal, and outputs the sync signal to the sync pulse generating unit 105 for each field or each subfield.

Further, the T1 setting unit 102 that outputs a number of sustain pulses to be is applied in a discharge sustain period is connected to the preprocessor 101. The number of the sustain pulses to be applied may be a predetermined number, in the embodiments, or the number may be calculated by the preprocessor 101 for each frame based on the inputted display signal.

After receiving information about the number of the sustain pulses to be applied, the T1 setting unit 102 sets an extension time period $T_1$ based on the received information about the number of the sustain pulses and by referring to a T1 table stored in advance in the T1 table storage unit 103. The T1 setting unit 102 then outputs the extension time period $T_1$, to the preprocessor 101 and the sync pulse generating unit 105. After receiving the extension time period $T_1$, the preprocessor 101 sets a timing of operations in the subfields.

The extension time period $T_1$ is a length of time that is set for each subfield and added to a time period from an end of the sustain discharge in one subfield until a beginning of a write period of a succeeding subfield. The extension time period $T_1$ is set based on the number of pulses stepwise, and added to a base time. The base time is a time period from the end of the sustain discharge in one subfield until the beginning of a write period of a succeeding subfield, where the number of the sustain pulses is less than 25.

An example of T1 tables stored in the T1 table storage unit 103 is shown as Table 1.

TABLE 1

| Number of Sustain Pulses | Extension Time Period $T_1$ (μsec) |
|---|---|
| 1–24 | 0 |
| 25–49 | 160 |
| 50–79 | 180 |
| greater than 80 | 200 |

As shown in Table 1, the extension time period $T_1$ to be added to a base time $T_0$, which is the length of time when the number of the sustain pulses is under 25, is 160 μsec when the number of the sustain pulses is in a range of 25 to 49, 180 μsec when the number of the sustain pulses is in a range of 50 to 79, and 200 μsec when the number of the sustain pulses is more than 80. In other words, the length of time from the end of the sustain discharge in one subfield till the beginning of the write period in the succeeding subfield is set so as to become longer when the more sustain pulses are applied in the discharge sustain period.

The frame memory 104 is a 2-port frame memory having two memory areas. One memory area is for one field and stores 8 subfield display signals. The memory frame 104 reads the stored subfield display signals in one of the two memory areas while writing the field display signal into the other of the memory areas, and repeats the operation alternately.

By referring to the sync signal transmitted from the preprocessor 101 for each field or each subfield, the sync pulse generating unit 105 generates a trigger signal that indicates timings of application of an initialize pulse, a scan pulse, a sustain pulse, and an erase pulse, and then sends the trigger signal to the drivers 106, 107, and 108.

The scan driver 106 includes an initialize pulse generating unit and a write pulse generating unit, and generates the initialize pulse and the write pulse based on the trigger signal sent from the sync pulse generating unit 105, and then applies the generated pulses to scanning electrodes SCN1–SCNn provided for the PDP 1.

The sustain driver 107 includes a sustain pulse generating unit and an erase pulse generating unit, and generates the sustain pulse and the erase pulse based on the trigger signal sent from the sync pulse generating unit 105, and then applies the generated pulses to the sustain electrodes SUS1–SUSn.

The data driver 108 outputs the data pulse to data electrodes D1–Dm in parallel, based on information for each subfield corresponding to one line that has been inputted serially.

In a case of the above described plasma display device, one subfield is made of a sequence including an initialization period, the write period, the discharge sustain period, and an erase period.

In the initialization period, the initialize pulse is applied to the scanning electrodes SCN1–SCNn so as to initialize all the charges in the discharge cells.

In the write period, the data pulses are applied to data electrodes selected from the data electrodes D1–Dm, while the write pulses are applied to the scanning electrodes SCN1–SCNn in an order. A wall charge is accumulated at the electrodes to which the data pulses have been applied, and image information is written in.

In the discharge sustain period, the sustain pulses with a voltage lower than a discharge firing voltage and the same polarity as the wall charge formed by the previous discharge are applied between the sustain electrodes SUS and all of the scanning electrodes SCN1–SCNn, and the discharge is caused in the discharge cells in which the wall charges are accumulated in the write period, and have emit light for a predetermined length of time.

In the erase period, the wall charge in the discharge cells are erased by applying narrow erase pulses to the scanning electrodes SCN1–SCNn at the same time. In some cases, the initialization period is provided only for a subfield at the top of one field. In such a case, it is necessary that the erase pulses applied in the rest of the subfields serve the role of the initialize pulses as well.

In a commonly used driving method, a number of pulses applied in each field is determined cyclically. Accordingly, it is possible to set the extension time period $T_1$ for each subfield in advance, instead of having the T1 setting unit 102 set the extension time period $T_1$ for each subfield.

With the plasma display device, the discharge cells in which the wall charge is accumulated during the write period by the address discharge emit light when the sustain pulses are applied in the discharge sustain period.

[First Embodiment]

Figure 3:
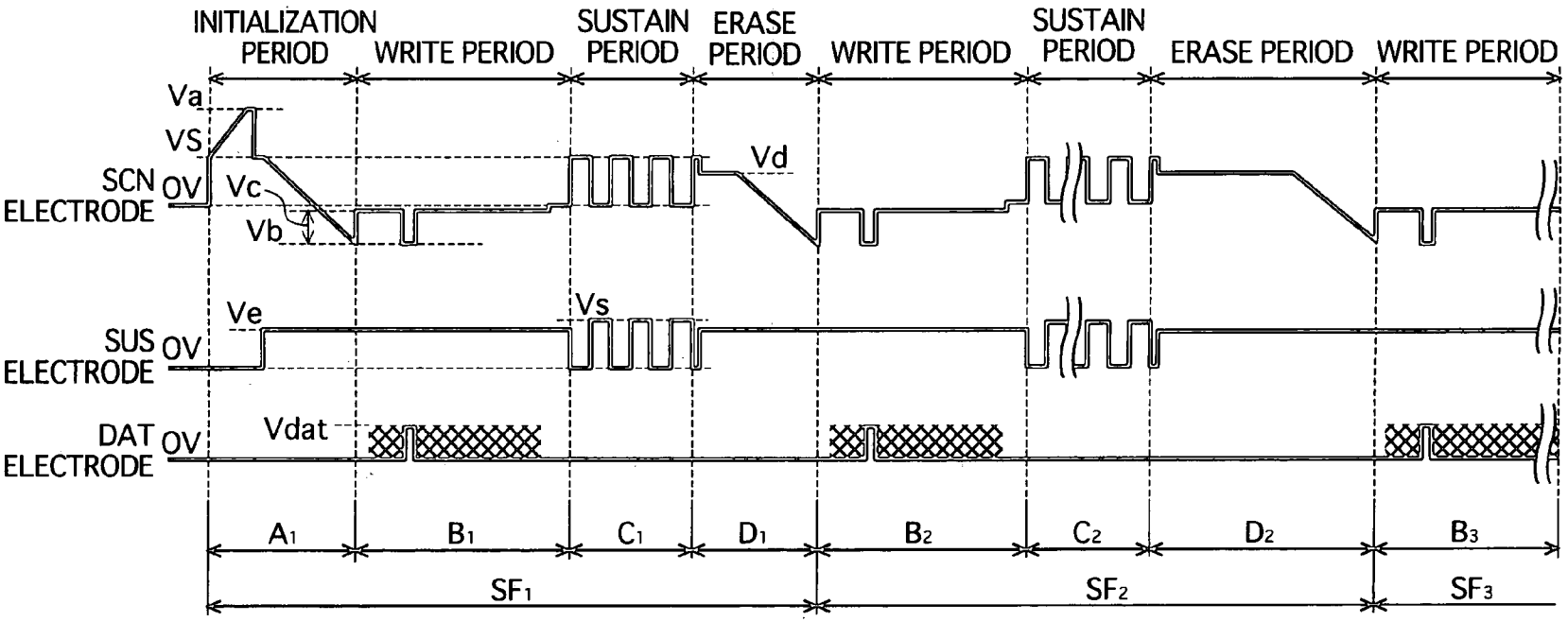
FIG. 3 illustrates waveforms of applied pulses in a driving method of a first embodiment of the present invention.

A method of driving the plasma display device according to a first embodiment is explained in reference to FIG. 3. FIG. 3 illustrates waveforms of pulses applied to each electrode.

As shown in FIG. 3, a subfield (hereinafter referred to as SF) 1 includes an initialization period A1, a write period B1, a discharge sustain period C1, and an erase period D1.

In the initialization period A1, all the charges in the discharge cells are initialized by applying a positive pulse voltage Va to the scanning electrodes SCN1–SCNn and then applying a negative pulse voltage Vb.

The initialization period is provided only for the SF 1, as shown in FIG. 3.

In the write period B1 after the initialization period A1, in order to display a first line, the write pulse voltage Vb is applied to the scanning electrode SCN1, and the address discharge is caused in the discharge spaces 30 corresponding to the discharge cells between the scanning electrode SCN1 and the data electrodes D1–Dm. By the discharge, the wall charge is accumulated on the surface of the dielectric glass layer 13 on the front panel 10, and an address operation for the first line is performed.

In the write period B1, the above operation is performed in an order from the first line to an n-th line, and a latent image for one screen is written in upon completion of the n-th address operation.

Next, in the discharge sustain period C1, the data electrodes D1–Dm are set at a ground potential, and a rectangular sustain pulse voltage Vs is applied to the scanning electrodes SCN1–SCNn and the sustaining electrodes SUS1–SUn alternately. By this, in the discharge sustain period C1, the sustain discharge is caused in the discharge cells in which the address operation is performed in the write period B1, and light is emitted continuously.

In the erase period D1, the wall charge less than the discharge firing voltage and even in an entire panel is accumulated by applying a ramp voltage after the wall charge is erased by application of an erase pulse. A length of the erase period D1 is the same as the base time $T_0$ because the number of the sustain pulses in the discharge sustain period C1 is less than 25. A length of the base time $T_0$ is about 140 μsec, for example.

A difference between the SF1 and a succeeding SF2 is the number of sustain pulses to be applied, a length of an erase period D2, and that the SF2 does not include the initialization period.

First, in a discharge sustain period C2, sustain pulses greater than or equal to 25 and less than 50 are applied. By this, as in the SF1, the sustain discharge is caused in the discharge cells in which the address operation is performed in a write period B2, and light is emitted continuously.

Next, in the erase period D2, based on that the number of the sustain pulses applied in the discharge sustain period C2 is greater than or equal to 25 and less than 50, a length of the erase period D2 is set at the base time $T_0$+160 μsec. The length of the erase period D2 is set by the preprocessor 101 by adding, to the base time $T_0$, the extension time period $T_1$ set by the T1 setting unit 102 based on the number of the sustain pulses outputted from the preprocessor 101 and the T1 table (Table 1) that is stored in the T1 table storage unit in advance. In other words, the T1 setting unit 102 refers to the extension time period $T_1$ for the number of the sustain pulses in a range of 25 to 49 in Table 1, and sets $T_1$=160 μsec. Thus, the length of the erase period D2 set by the preprocessor 101 is $T_0+T_1$=140+160=300 μsec.

In the erase period D2 having the duration set in the above manner, the wall charge is erased, and then, the wall charge less than the discharge firing voltage and even in an entire pane is accumulated, like in the erase period D1.

After the erase period D2, a write period B3 in a SF3 starts.

In the plasma display device driven at the above described timing, the wall charge at the beginning of the write period B3 in the SF3 is sufficiently maintained. The wall charge here indicates the charge accumulated in the preceding erase period D2.

Accordingly, with the plasma display device having the above driving method, charge errors where the charge is not accumulated do not easily occur during a period from an end of the discharge sustain period C2 until the write period B3 starts, even when low voltage pulses are applied in the address operation in the write period B3.

The 160 μsec of the extension time period $T_1$ in the erase period D2 is obtained in the following manner.

Generally, with a conventional plasma display device driven in an intra-field time division grayscale display method, not all time period in a field is assigned to all periods, and each field have a spare time period to be assigned to each subfield for time adjustment. The extension time period $T_1$ is added by using the spare time period, and accordingly, addition of the extension time period does not change a length of a whole field (16.6 msec).

In a case in which the extension time period $T_1$ is a maximum length (200 μsec), and added to all subfields in the same field, it is possible to effectively suppress the write errors. However, a total length of the erase periods in the field becomes long. When the total length of the erase periods becomes long, it is necessary to reduce a length of other periods (e.g. discharge sustain periods) in order to maintain all fields in the same length.

On the other hand, with the plasma display device according to the present embodiments, it is possible to obtain excellent image qualities by setting a bare minimum extension time period $T_1$ for each subfield in order to suppress the write errors.

Further, the assignment of the extension time period in the erase period D2 is not restricted to the manner shown in FIG. 3. For example, the extension time period $T_1$ may be added to a ramp part and make a ramp waveform more gradual, in order to suppress discharge errors when accumulating the wall charge.

In addition, it is preferable to set the erase period in a rage of 160 μsec to 460 μsec in practice.

[How Charge Errors are Suppressed]

Figure 4B:
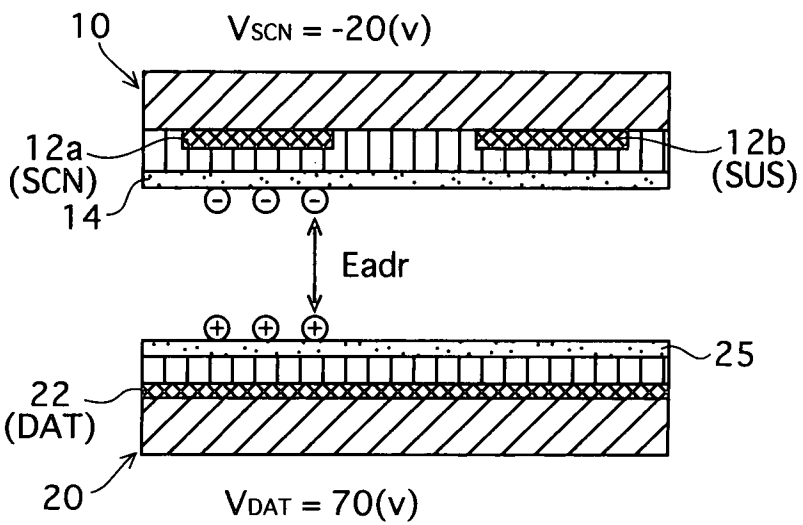
FIGS. 4A and 4B show schematic diagrams illustrating an amount of charge formed during a discharge sustain period and a write period.
Figure 4A:
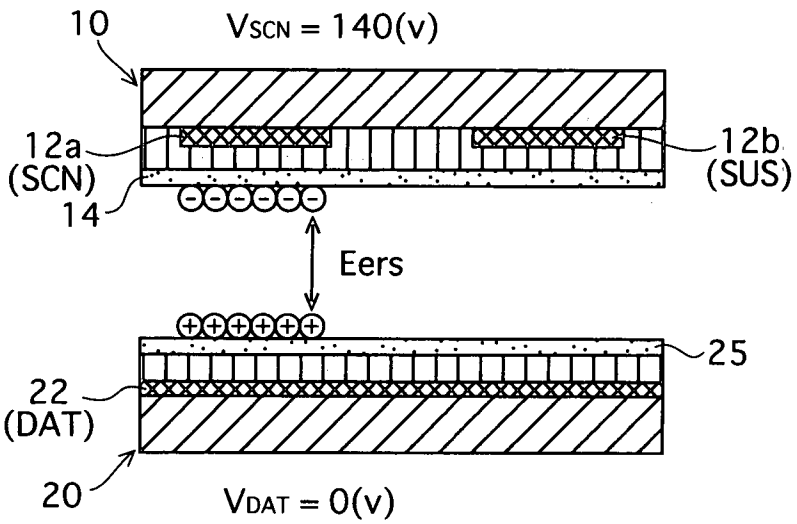
Figure 5:
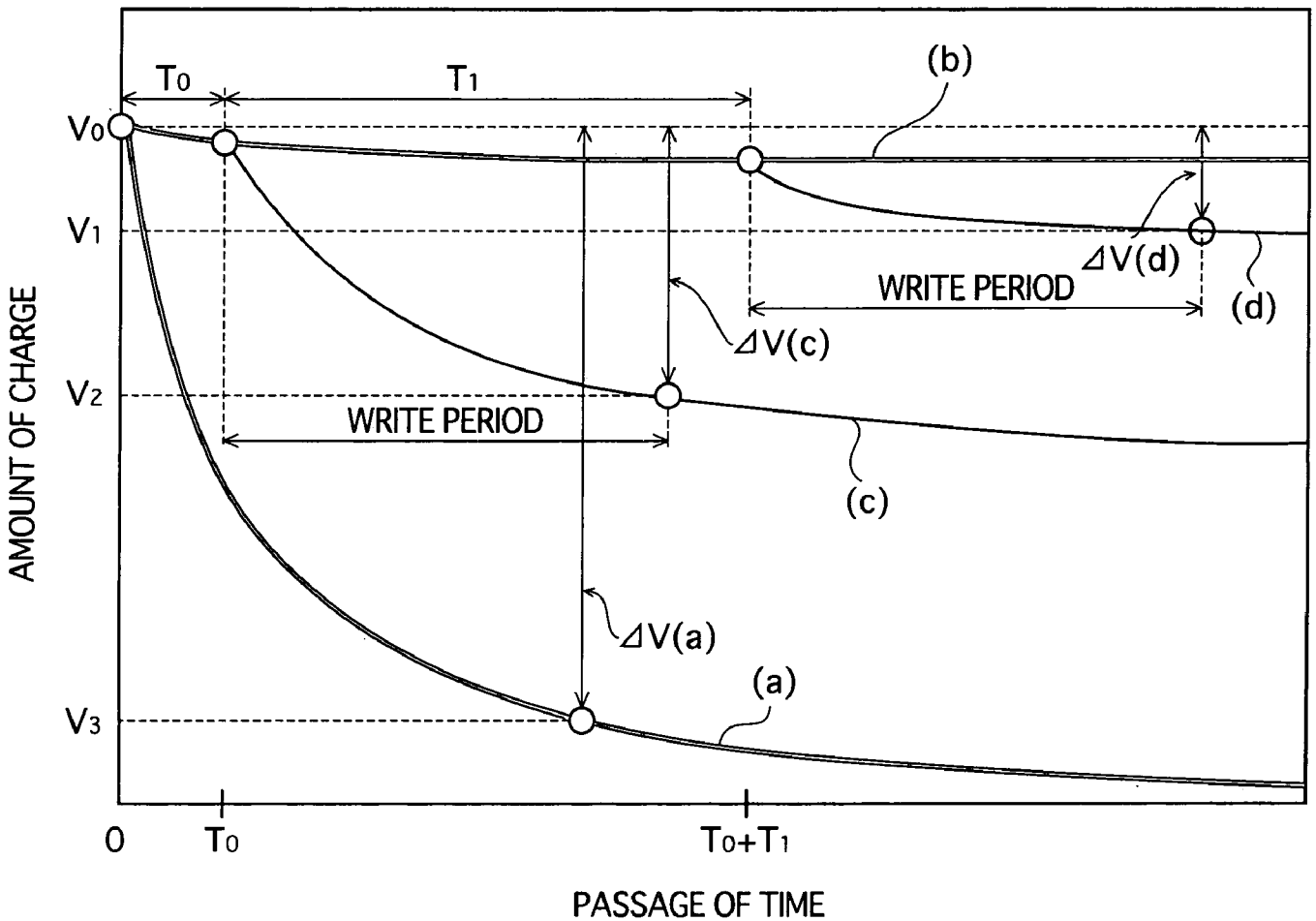
FIG. 5 is a graph illustrating a relation between passage of time and the amount of charge from an end of the discharge sustain period.

Next, an explanation about how the charge errors where the charge is not accumulated can be suppressed when the length of the erase period D2 is extended based on the number of the sustain pulses applied in the preceding discharge sustain period C2 in reference to FIGS. 4 and 5. FIG. 4 shows schematic diagrams illustrating an amount of charge formed during a discharge sustain period and a write period. FIG. 5 is a graph illustrating a relation between passage of time and the amount of charge from an end of the discharge sustain period.

As shown in FIG. 4A, after the discharge sustain period, a pulse having a voltage Vscn of 140 v is applied to the scanning electrodes 12*a* (SCN), and a voltage of the data electrodes 22 (D) is set at a voltage Vdat of 0 v (ground potential). A state of the wall charge after the application of the pulses is that the wall charge is accumulated on the surface of the front panel 10. By this, an electrical field Eers is formed between the scanning electrodes 12*a* on the front panel 10 and the data electrodes 22 on the back panel 20. Here, the voltage Vscn corresponds to the Voltage Vd in the erase periods D1 and D3 in FIG. 3.

On the other hand, as shown in FIG. 4B, in the write period, a pulse having a voltage Vscn of −20 v is applied to the scanning electrodes 12*a* (SCN), and a pulse having a voltage Vdat of 70 v is applied to the data electrodes 22 (D). A state of the wall charge after the application of the pulses is that the wall charge is accumulated on the surface of the front panel 10, but the amount of the wall charge is smaller than the amount in FIG. 4A. By this, an electrical field Ears is formed between the scanning electrodes 12*a* on the front panel 10 and the data electrodes 22 on the back panel 20.

A relation between the electrical field Eers and the electrical field Ears is Eers<Ears.

Next, a relation between a time period from an end of the discharge sustain period until an application of the write pulse (the erase period in FIG. 3) and an amount of the wall charge accumulated between the scanning electrodes 12*a* and the data electrodes 22 (the amount of the charge) is explained in reference to FIG. 5. In FIG. 5, the horizontal axis of the graph indicates the passage of time from the end of the discharge sustain period, and the vertical axis indicates the amount of charge.

FIG. 5 shows changes in the charge in the following four cases:

(a) a applying the electric field Eadr right after the discharge sustain period ends, (b) applying the electric field Eers right after the discharge sustain period ends, (c) starting the write period at a point when a time period $T_0$ has passed since the discharge sustain period ends, and (d) starting the write period at a point when a time period $T_0+T_1$ has passed since the discharge sustain period ends.

As shown in FIG. 5, the amount of charge for each case reduces at an exponential rate. A decrease rate in the amount of charge to the passage of time in characteristic curve (a) is notably greater than other characteristic curves (b), (c), and (d). If the write pulse is applied right after the discharge sustain period ends, an amount of charge that is not accumulated is ΔV(a). The following is a reason why the amount of charge that is not accumulated is greater in the characteristic curve (a).

At the time right after the discharge sustain period ends shown in FIG. 4A, charges also exist in the discharge space 30 in addition to the wall of the space, due to impurity level from an impurity gas (a molecule gas containing a large amount of carbon, oxygen, hydrogen, nitrogen, and such) in the discharge space 30. In other words, when the discharge sustain period just ends, the impurity level has been generated between the impurity gas and the phosphor layers 50, and between the impurity gas and the dielectric protecting layer 14. Accordingly, if the electric field Eadr is applied right after the discharge sustain period ends, the accumulated wall charge is discharged into the discharge space due to an influence of the impurity level, and thus the charge is not accumulated.

The characteristic curve (b) indicates the change in the amount of charge when the electric field Eers that is weaker than the electric field Eadr. As is clear from the graph, the decrease rate is small.

The characteristic curve (c) indicates the change in the amount of charge using a conventional driving method. The characteristic curve (c) shifts along the characteristic curve (b) until when the time period $T_0$ passes after the end of the discharge sustain period, and then the write period starts. An amount of the charge that is not accumulated in the case of the characteristic curve (c) is ΔV(c), and the amount of charge right after the discharge sustain period ends is V2. The amount ΔV(c) of the charge that is not accumulated is a total amount of decrease caused by the electric field Eers applied in $T_0$ and by the electric field Eadr applied in the write period.

With the conventional plasma display device having the above characteristics, a total amount of the remaining charge and the applied write pulse voltage does not reach the discharge firing voltage because a sufficient amount of charge is not accumulated. In such a case, the write errors could occur.

The characteristic curve (d) indicates the change in the amount of the charge in a case where an application of the write pulse starts at a point when a total of the time period $T_0$ and the extension time period $T_1$ passes after the end of the discharge sustain period.

As shown in FIG. 5, the characteristic curve (d) decreases along the characteristic curve (b) during a time period ($T_0$+$T_1$) from the end of the discharge sustain pulse, and then the electric field Eadr is applied when the write period starts at the point when the time period ($T_0$+$T_1$) passes. The decrease rate right after the application of the electric field Eadr is more gradual than the characteristic curves (a) and (c). An amount of the charge that is not accumulated till the end of the write period is ΔV(d) and an amount of remaining charge is V1, because providing the extension time period $T_1$ could reduce the impurity level caused during the discharge sustain period, and thus the charge errors where the charge is not accumulated are suppressed.

Note that with an actual plasma display device, an amount of the impurity gas also affects a degree of the charge errors where the charge is not accumulated. The amount of remaining charge at the end of application of the pulses in the write period tends to be smaller when a greater amount of the impurity remains.

However, in a case where the write period starts after the time period ($T_0$+$T_1$) passes, as in the case of the characteristic curve (d), an effect can be achieved relatively even when the impurity gas remains in the discharge space 30. Accordingly, when a period from the end of discharge sustain period until the beginning of the write period is the time period ($T_0$+$T_1$), the write errors can be suppressed even if the discharge space 30 after the sealing of the panels is not at a higher vacuum than a necessary level, and an advantageous effect can also be achieved in terms with the production cost.

[Second Embodiment]

Figure 6:
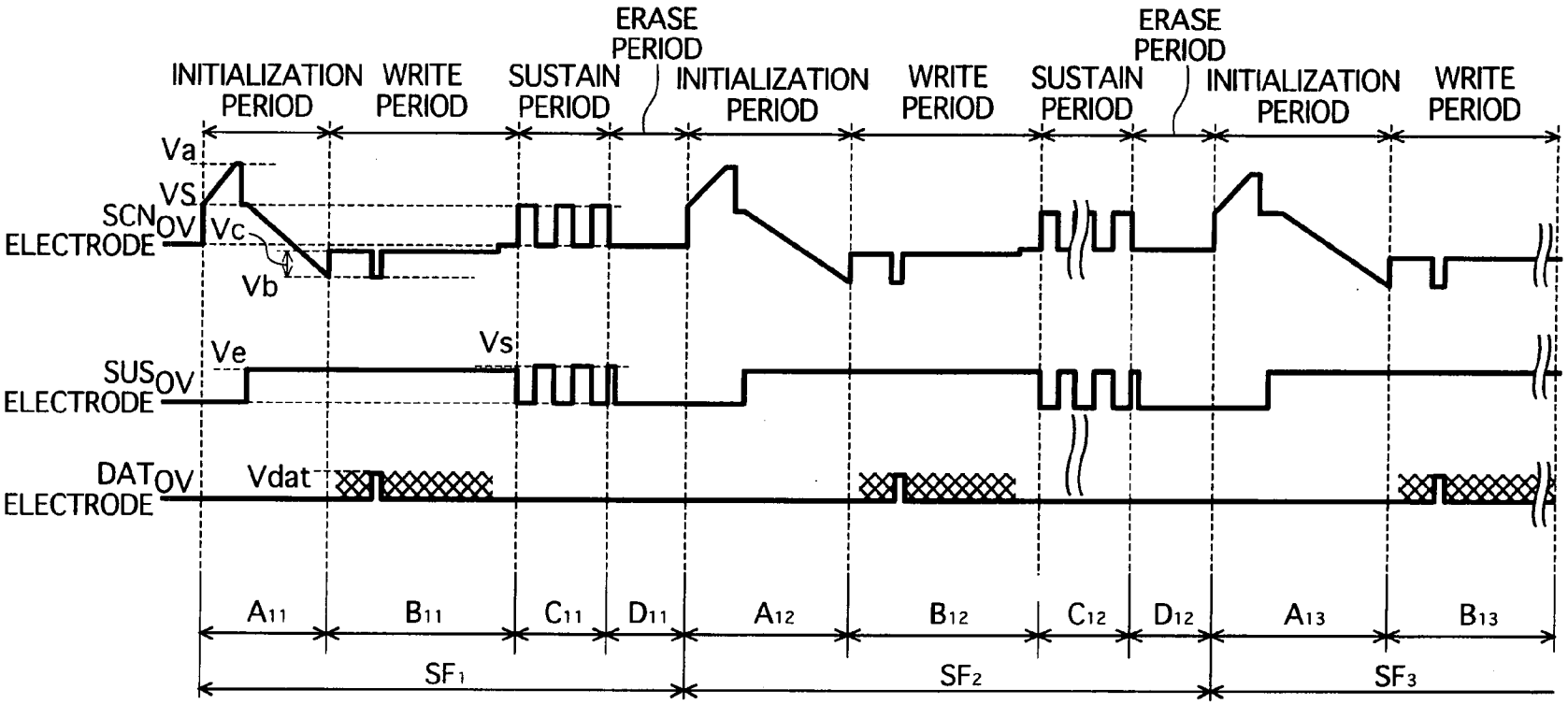
FIG. 6 illustrates waveforms of applied pulses in a driving method of a second embodiment of the present invention.

Next, a method of driving the plasma display device according to a second embodiment is explained in reference to FIG. 6.

The plasma display panel according to the second embodiment is the same as the plasma display device in the first embodiment.

As shown in FIG. 6, the driving method of the present embodiment is different from the driving method of the first embodiment in that all subfields in the second embodiment includes the initialization period, the write period, the discharge sustain period, and the erase period.

In an erase period D11 in the SF1, rectangular pulses for erasing the wall charge in the discharge spaces 30 are applied to the sustain electrodes SUS1–SUSn, because the SF2 includes an initialization period A12.

In the initialization period A12 in the SF2, the same initialize pulse that has been applied in an initialization period A11 in the SF1 is applied. Here, a length of the initialization period A12 is the same with the initialization period A11 in the SF1, because a number of sustain pulses that has been applied in a discharge sustain period C11 in the SF1 is less than 25.

In a discharge sustain period C12 in the SF2, the data electrodes D1–Dm are grounded, and a rectangular sustain pulse voltage Vs is applied alternately to the scanning electrodes SCN1–SCNn and the sustaining electrodes SUS1–SUSn. By this, in the discharge sustain period C12, the sustain discharge is generated in discharge cells in which the address operation has been performed in the write period B12, and lights are emitted continuously. The number of pulses applied in this period is greater than or equal to 25 and less than 50.

A length of an initialization period A13 in a SF2 is set longer than the initialization period A12 by a length of the extension time period $T_1$ (160 μsec). The length of the extension time period $T_1$ is set by the T1 setting unit 102 based on the number of the sustain pulses in the preceding discharge sustain period C12 (greater than or equal to 25 and less than 50). In other words, in the driving method of the present embodiment, the extension time period $T_1$ is set for each subfield, and the set extension time period $T_1$ is added to the initialization period.

As has been described in the above, in a case in which the length of the initialization period is set based on the number of the sustain pulses in the preceding discharge sustain period, a length of time from the end of the discharge sustain period until the application of the write pulses in the write period is set accordingly based on the number of the sustain pulses, and it is possible to suppress the charge errors where the charge is not accumulated. The reason why this is possible is the same as in the case of the first embodiment in which the length of the erase period is set based on the number of the sustain pulses in the preceding subfield.

The wall charge of concern is the wall charge accumulated in the initialization period A13.

Accordingly, with the plasma display device according to the present embodiment, it is also possible to achieve excellent image qualities by suppressing the write errors, even when driving at a low voltage.

Note that the extension time period $T_1$ is assigned using the spare time of the same field. Therefore, the length of one field 16.6 msec does not change.

Further, it is preferable that the length of the initialization period in each subfield is set in a range of 360 μsec to 660 μsec for an actual plasma display device.

[Third Embodiment]

Figure 7:
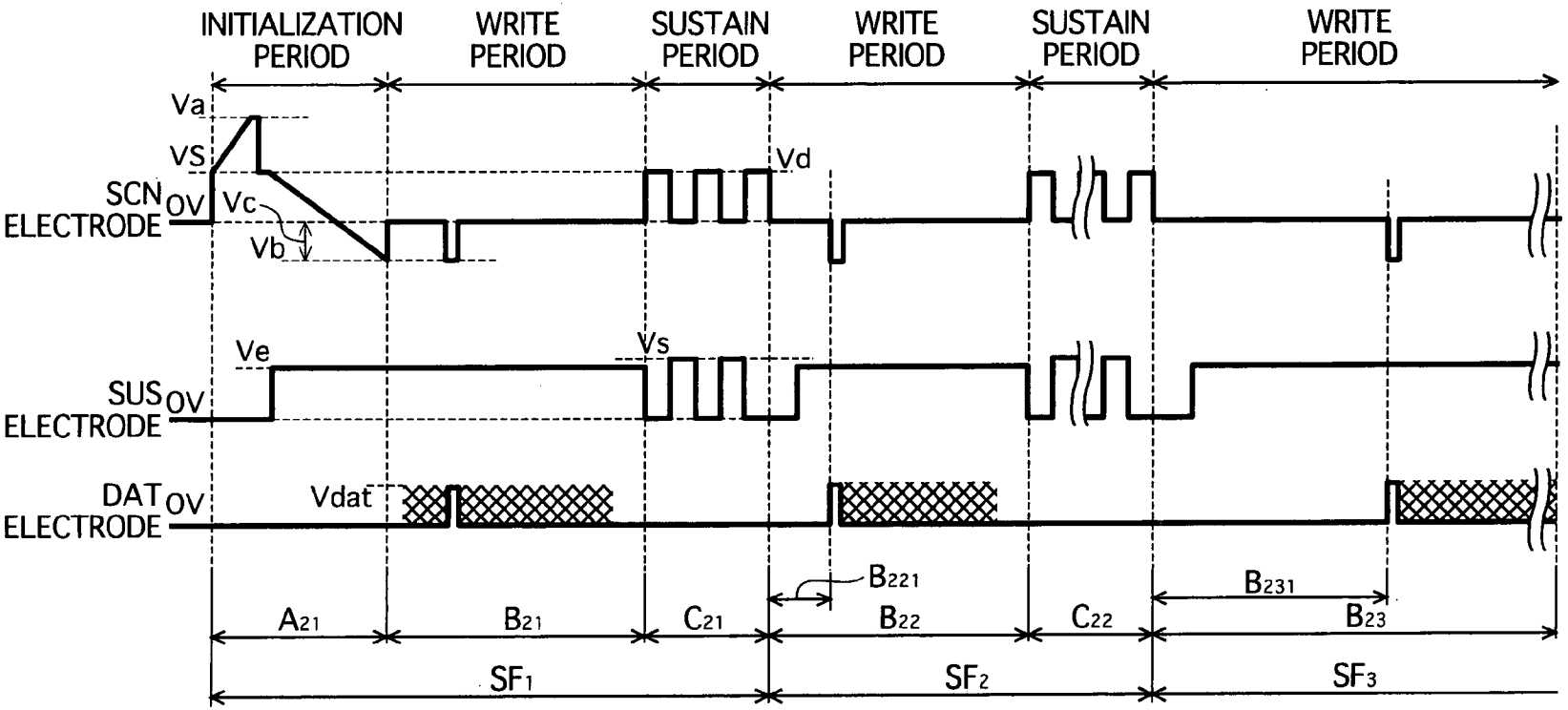
FIG. 7 illustrates waveforms of applied pulses in a driving method of a third embodiment of the present invention.

Next, a method of driving the plasma display device according to a third embodiment is explained in reference to FIG. 7.

The plasma display panel according to the third embodiment is the same as the plasma display device in the first and second embodiments.

As shown in FIG. 7, the driving method of the present embodiment is different from the driving method of the first and second embodiments in that all subfields (SF1–SFn) in the third embodiment do not include the erase period. In addition, the initialization period is not included in the SF2–SFn.

In the driving method of the present embodiment, the time period from the beginning of the write period until the write pulse is actually applied is set based on the number of sustain pulses applied in the preceding discharge sustain period. Specifically, when the number of the sustain pulses is greater than or equal to 25 and less than 50 in the sustain period C22 of SF2, the write period B23 in the SF3 is longer by the length of the extension time period $T_1$ than B21 in the SF1 and the B22 in the SF2.

In the drawing, a waiting time period B231 in the write period B23 is set longer by 160 μsec than a waiting time period B211 in the write period B21 and a waiting time period B221 in the write period B22.

With the plasma display device with the above described driving method, it is possible to avoid that the amount of the remaining charge in the write period becomes lower than a voltage indicated by the difference between the discharge firing voltage in the write period and the write pulse voltage.

Accordingly, with the above described plasma display device, it is also possible to achieve excellent image qualities by suppressing the write errors, even when driving at a low voltage.

Note that it is preferable that the time period from the end of the sustain period until the application of the write pulse is set in a range of 10 μsec to 820 μsec for an actual plasma display device.

Further, as in the first and second embodiments, the extension time period $T_1$ here is also assigned using the spare time in the same field.

[Other Matters]

Although, in the above embodiments, the T1 setting unit 102 sets the extension time period $T_1$ by referring to the table of Table 1 based on the number of the sustain pulses, the present invention is not restrict to the above examples if the extension time period $T_1$ is set in a range shown in Table 2 below.

TABLE 2

| Number of Sustain Pulses | Range of Desired Extension Time Period $T_1$ (μsec) |
|---|---|
| 1–24 | 0 |
| 25–49 | 20–300 |
| 50–79 | 40–320 |
| more than 80 | 60–340 |

Further, in the above embodiments, the extension time period $T_1$ is added to the time period from the end of the discharge sustain period in one subfield until the application of the write pulse in a succeeding subfield based on the number of the sustain pulses in the said subfield. However, it is possible to achieve even more excellent image qualities if this is applied to a length of each field. A specific example of this driving method is such that a second extension time period $T_2$ is added to a field when the amount of accumulated wall charge in the preceding field is large (high luminance), while the second extension time period $T_2$ is not added to a field when the amount of accumulated wall charge in the preceding field is small (low luminance). The second extension time period $T_2$ is added in addition to the extension time period $T_1$ that is set for each subfield.

Specifically, a T2 setting unit is provided in addition to the T1 setting unit 102. The T2 setting unit detects luminance for each field. When the detected luminance is less than a threshold, the second extension time period $T_2$ is not added to the succeeding field. When the detected luminance is greater than the threshold, the second extension time period $T_2$ is transmitted to the preprocessor 101, and the preprocessor 101 sets the timing of the operation in each subfield by adding the extension time periods $T_1$ and $T_2$.

Further, the plasma display device used in the explanations for the embodiments is just an example. A structure of the device, material to be used for the device, and a method of manufacturing the device including the driving device are not restricted to the above example.

[Experiment for Confirmation]

Figure 8:
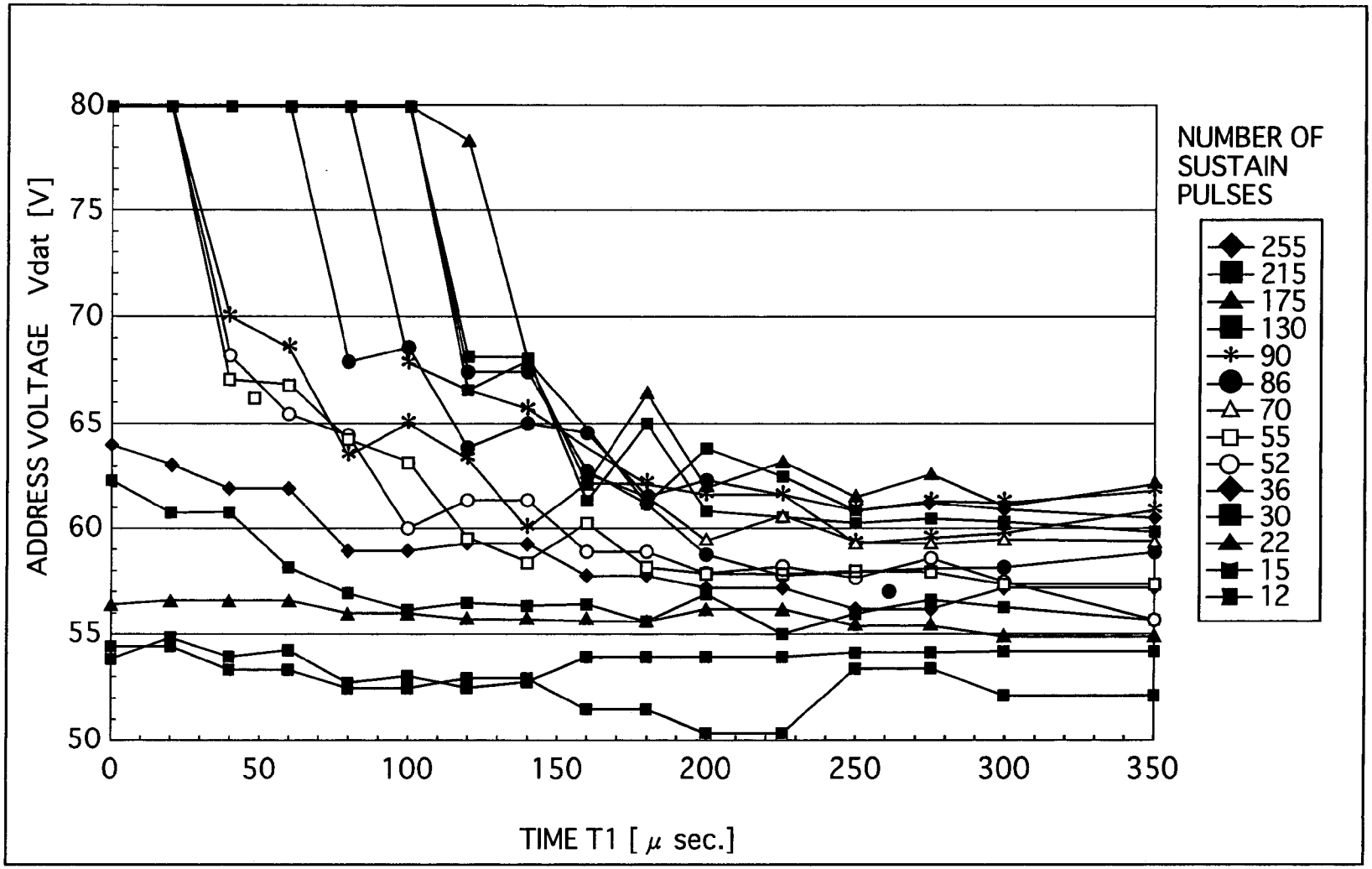
FIG. 8 is a graph illustrating a relation between an extension time period $T_1$ and an address pulse voltage.
Figure 9:
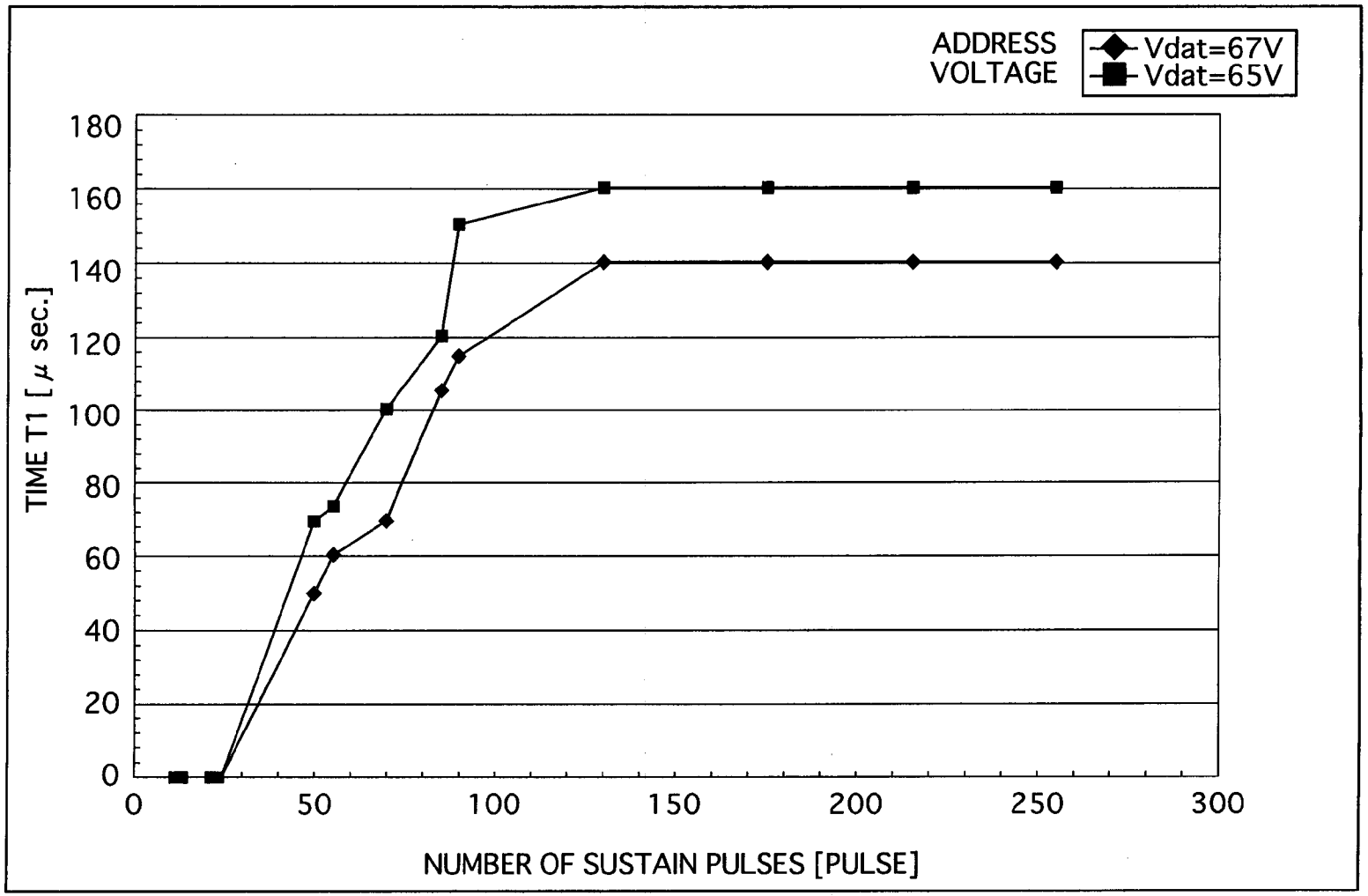
FIG. 9 is a graph illustrating a relation between a number of sustain pulse and the extension time period $T_1$.

Next, an experiment conducted in order to confirm the effect of the present invention is explained in reference to FIGS. 8 and 9.

In the experiment, sizes of parts of a PDP were set as follows.

Thickness of the dielectric glass layer 13: 42 μm

Thickness of the dielectric protecting layer 14: 0.5–0.8 μm

Width of a gap between the scanning electrode 12*a* and the sustain electrode 12*b*: 80 μm Height of the barrier ribs 24: 120 μm Base time period $T_0$: 140 μsec Further, the applied pulse voltages in FIG. 3 were set as follows.

Va=220 v

Vb=100 v

Vc=80 v

Vd=140 v

Ve=150 v

Vs=180 v

In the experiment, using the plasma display device with the above listed sizes and voltages, the necessary write pulse voltage was measured for each subfield with different numbers of the sustain pulses (12, 15, . . . , 215, 255) in the discharge sustain period of the preceding subfield, when the extension time period $T_1$ shifts. FIG. 8 is a graph illustrating results of the measurement.

As shown in FIG. 8, when the number of the sustain pulses is less than 25, the necessary write pulse voltage Vdat is stable at lower than 57 v, and any notable change is not observed.

In a case in which the number of the sustain pulse is greater than or equal to 25 and less than 50 and when the extension time period $T_1$ is shorter than 20 μsec, the necessary write pulse voltage Vdat is stable around 60 v to 64 v. When the extension time period $T_1$ is in a range of 20 μsec to 300 μsec, the voltage Vdat decreases as the extension time period $T_1$ becomes longer. When the extension time period $T_1$ is longer than 300 μsec, the necessary write pulse voltage Vdat is stable around a range of 55 to 58 v.

In a case in which the number of the sustain pulse is greater than or equal to 50 and less than 80, the necessary write pulse voltage Vdat is stable around 80 v, when the extension time period $T_1$ is shorter than 40 μsec. When the extension time period $T_1$ is in a range of 40 μsec to 320 μsec, the voltage Vdat decreases at an exponential rate as the extension time period $T_1$ becomes longer. When the extension time period $T_1$ was longer than 320 μsec, the necessary write pulse voltage Vdat is stable around 58 v to 60 v.

In a case in which the number of the sustain pulse is greater than 80, the necessary write pulse voltage Vdat is stable around 80 v, when the extension time period $T_1$ is shorter than 60 μsec. When the extension time period $T_1$ is in a range of 60 μsec to 340 μsec, the voltage Vdat decreases at an exponential rate as the extension time period $T_1$ becomes longer. When the extension time period $T_1$ is longer than 340 μsec, the necessary write pulse voltage Vdat was stable around 60 v to 63 v.

From the above results of the experimentation, it becomes clear that, in a case of the number of the sustain pulses is greater than 25, the write pulse voltage is required to be set higher as the extension time period $T_1$ is shorter, and the extension time period $T_1$ is set longer as the number of the sustain pulses is greater, in order to suppress the amount of the necessary write pulse voltage Vdat low.

Note that the decreased amount of charge in FIG. 8 is lower than a voltage indicated by the difference between the discharge firing voltage in the write period and the write pulse voltage Vdat in the drawing.

Further, in the drawing, the write pulse voltage Vdat is substantially constant in an area where the number of the sustain pulses is greater than 55 and the extension time period $T_1$ is short. This is because the measurement of the write pulse voltage Vdat was conducted with a maximum voltage for measurement at 80 v.

Next, using the same plasma display device, a relation between the number of the sustain pulses and the necessary extension time period $T_1$ was measured for two different values of the write pulse voltage Vdat. FIG. 9 shows results of the measurement. The necessary extension time period $T_1$ here refers to a minimum extension time period which is necessary for not causing the write errors when the write pulse voltage is set at the same voltage. The number of the sustain pulses in the drawing indicates the number of the sustain pulses applied in the discharge sustain period of the preceding subfield.

As shown in FIG. 9, in a case in which the number of the sustain pulses applied in the discharge sustain period is less than 25, the necessary extension time period $T_1$ is 0 μsec. In other words, when the number of the sustain pulses is less than 25, the write errors in the write period are not caused even if the extension time period $T_1$ is not added.

In a case in which the number of the sustain pulses is greater than or equal to 25 and less than 130, the extension time period $T_1$ becomes longer as the number of the sustain pulses increases. This trend can be observed both in cases where the write pulse voltage Vdat is 65 v, and where the write pulse voltage Vdat is 67 v.

Accordingly, from the diagrams illustrated in FIGS. 8 and 9, it is preferable that the extension time period $T_1$ is set based on the number of the sustain pulses applied in the discharge sustain period. Specifically, the extension time period $T_1$ is set in a following manner.

When the number of the sustain pulses applied in the discharge sustain period is less than 25, the extension time period $T_1$ is set 0. In other words, the time period is not extended in this case, and the time period from the end of the discharge period until the application of the write pulse is the same as the base time period $T_0$ (140 μsec).

When the number of the sustain pulses applied in the discharge sustain period is greater than or equal to 25 and less than 50, the extension time period $T_1$ is set in a range of 20 μsec to 300 μsec.

When the number of the sustain pulses applied in the discharge sustain period is greater than or equal to 50 and less than 80, the extension time period $T_1$ is set in a range of 40 μsec to 320 μsec.

When the number of the sustain pulses applied in the discharge sustain period is greater than 80, the extension time period $T_1$ is set in a range of 60 μsec to 340 μsec.

Each of the extension time period $T_1$ is written in a table in advance and stored in the T1 table storage unit 103 illustrated in FIG. 2.

The results of this experiment were obtained using the sizes and voltages stated in the above. However, by setting the time period from the end of the discharge sustain period until the application of the write pulse for each subfield or each field based on the number of the sustain pulses, it is possible to obtain an effect that the charge errors where the charge is not accumulated during the time period is suppressed, even with a plasma display device having sizes and voltages other than stated above.

INDUSTRIAL APPLICABLITY

A plasma display device and a method of driving the plasma display device according to the present invention are advantageous in order to obtain display devices for computers and television sets, and especially display devices with high image qualities.

The invention claimed is:

1. A plasma display device comprising (i) a plasma display panel with a plurality of discharge cells between front and back panels, and (ii) a driving circuit operable to drive the plasma display panel to display a grayscale image by selectively having the discharge cells emit light in a subfield with a desired luminance weight, a plurality of subfields with different luminance weights forming one field, wherein each subfield includes a write period and a discharge sustain period, at least two subfields are in a relation that (i) a number of sustain pulses applied in an m-th subfield is different from that in an n-th subfield, and (ii) a first time period from an end of the discharge sustain period in the m-th subfield until an application of a write pulse in an (m+1)-th subfield is different in length from a corresponding second time period between the n-th subfield and an (n+1)-th subfield, and wherein when the number of the sustain pulses in the m-th subfield is greater than or equal to a predetermined number, the first time period is calculated by adding an extension time period that is set based on the number of the sustain pulses in the m-th subfield to a base time period, where the base time period is a length of time from an end of the discharge sustain period in any subfield having sustain pulses less than the predetermined number until an application of the write pulse in a succeeding subfield, where each of m, n, (m+1), and (n+1) is a natural number that indicates a subfield number in one field.

2. A plasma display device according to claim 1, wherein the extension time period is set in a range of 20 μsec to 300 μsec, when the number of the sustain pulses in the m-th subfield is greater than or equal to 25 and less than 50, 40 μsec to 320 μsec, when the number of the sustain pulses in the m-th subfield is greater than or equal to 50 and less than 80, and 60 μsec to 340 μsec, when the number of the sustain pulses in the m-th subfield is greater than or equal to 80.

3. A plasma display device according to claim 2, wherein a length of time from the end of the discharge sustain period in each subfield until the application of the write pulse in a succeeding subfield is set in a range of 10 μsec to 820 μsec.

4. A plasma display device according to claim 1, wherein the driving circuit comprises:

a table storage unit that stores a table in which numbers of the sustain pulses correspond to extension time periods; and an extension time period setting unit operable to set the extension time period based on the number of the sustain pulses in the m-th subfield by referring to the table.

5. A plasma display device according to claim 1, wherein an erase period in which a wall charge is erased is provided after the discharge sustain period in the m-th subfield, and the extension time period is included in the erase period.

6. A plasma display device according to claim 5, wherein a length of the ease period in each subfield, is set in a range of 160 μsec to 460 μsec.

7. A plasma display device according to claim 1, wherein an initialization period in which a charge is initialized is provided before the write period, in each subfield, and the extension time period is included in the initialization period in the m-th subfield.

8. A plasma display device according to claim 7, wherein a length of the initialization period in each subfield is set in a range of 360 μsec to 660 μsec.

9. A plasma display device according to claim 1, wherein a length of time from the end of the discharge sustain period in each subfield until the application of the write pulse in a succeeding subfield is set in a range of 10 μsec to 820 μsec.

10. A plasma display device according to claim 1, wherein when a total number of the sustain pulses applied in one field is greater than or equal to another predetermined number, another extension time period is added to the length of time from the end of the discharge sustain period in each subfield until the application of the write pulse in a succeeding field.

11. A method of driving a plasma display device, the plasma display device including (i) a plasma display panel with a plurality of discharge cells between front and back panels, and (ii) a driving circuit operable to drive the plasma display panel to display a grayscale image by selectively having to discharge cells emit light in a subfield with a desired luminance weight, a plurality of subfields with different luminance weights forming one field, wherein each subfield includes a write period and a discharge sustain period, at least two subfields are in a relation that (i) a number of sustain pulses applied in an m-th subfield is different from that in an n-th subfield, and (ii) a first time period from an end of the discharge sustain period in the m-th subfield until an application of a write pulse in an (m+1)-th subfield is different in length from a corresponding second time period between the n-th subfield and an (n+1)-th subfield, and when the number of the sustain pulses in the m-th subfield is greater than or equal to a predetermined number, the first time period is calculated by adding an extension time period that is set based on the number of the sustain pulses in the m-th subfield to a base time period, where the base time period is a length of time from an end of the discharge sustain period in any subfield having sustain pulses less than the predetermined number until an application of the write pulse in a succeeding subfield, where each of m, n, (m+1) and (n+1) is a natural number that indicates a subfield number in one field.

12. A method of driving a plasma display device according to claim 11, wherein 20 μsec to 300 μsec, when the number of the sustain pulses in the m-th subfield is greater than or equal to 25 and less than 50, 40 μsec to 320 μsec, when the number of the sustain pulses in the m-th subfield is greater than or equal to 50 and less than 80, and 60 μsec to 340 μsec, when the number of the sustain pulses in the m-th subfield is greater than or equal to 80.

13. A method of driving a plasma display device according to claim 12, wherein a length of time from the end of the discharge sustain period in each subfield until the application of the write pulse in a succeeding subfield is set in a range of 10 μsec to 820 μsec.

14. A method of driving a plasma display device according to claim 11, wherein the extension time period is set by referring to the table in which numbers of the sustain pulses correspond to extension time periods.

15. A method of driving a plasma display device according to claim 11, wherein an erase period in which a wall charge is erased is provided after the discharge sustain period in the m-th subfield, and the extension time period is included in the erase period.

16. A method of driving a plasma display device according to claim 11, wherein an initialization period in which a charge is initialized is provided before the write period in each subfield, and the extension time period is included in the initialization period.

17. A method of driving a plasma display device according to claim 11, wherein when a total number of the sustain pulses applied in one field is greater than or equal to another predetermined number, another extension time period is added to the length of time from the end of the discharge sustain period in each subfield until the application of the write pulse in a succeeding field.

* * * * *

UNITED STATES PATENT AND TRADEMARK OFFICE

CERTIFICATE OF CORRECTION

PATENT NO. : 7,138,966 B2
APPLICATION NO. : 10/480557
DATED : November 21, 2006
INVENTOR(S) : Shindo et al.

It is certified that error appears in the above-identified patent and that said Letters Patent is hereby corrected as shown below:

Claim 6, Column 18, line 56, “ease” should be --erase--;
Claim 6, Column 18, line 56 the comma “,” after “subfield” should be deleted.
Claim 11, Column 19, line 37, a comma --,-- after “(m+1)” should be inserted.

Signed and Sealed this

Thirteenth Day of March, 2007

JON W. DUDAS
*Director of the United States Patent and Trademark Office*